US008939218B2

(12) United States Patent
Marshall et al.

(10) Patent No.: US 8,939,218 B2
(45) **Date of Patent: *Jan. 27, 2015**

(54) APPARATUS AND METHOD FOR THE INSTALLATION OR REMOVAL OF A ROTARY CONTROL DEVICE INSERT OR A COMPONENT THEREOF

(71) Applicant: JTB Tools & Oilfield Services, LLC, Houston, TX (US)

(72) Inventors: Barry Marshall, Monahans, TX (US); Gary Marshall, Houston, TX (US)

(73) Assignee: JTB Tools & Oilfield Services, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/222,205

(22) Filed: Mar. 21, 2014

(65) Prior Publication Data

US 2014/0291026 A1 Oct. 2, 2014

Related U.S. Application Data

(63) Continuation-in-part of application No. 13/456,437, filed on Apr. 26, 2012.

(51) Int. Cl.

| | |
|---|---|
| ***E21B 33/06*** | (2006.01) |
| ***E21B 19/00*** | (2006.01) |
| ***E21B 23/00*** | (2006.01) |

(52) U.S. Cl.

CPC ..... *E21B 19/00* (2013.01); *E21B 23/00* (2013.01)

USPC ..... 166/377; 166/84.3; 166/85.3; 294/90

(58) Field of Classification Search

USPC ..... 166/377, 84.3, 379, 85.3; 294/86.1, 294/86.2, 90

See application file for complete search history.

(56) References Cited

U.S. PATENT DOCUMENTS

| | | | | |
|---|---|---|---|---|
| 1,967,517 | A * | 7/1934 | Rogers | 175/57 |
| 2,054,223 | A * | 9/1936 | Le Bus | 173/164 |
| 3,915,244 | A * | 10/1975 | Brown | 175/85 |
| 4,783,084 | A * | 11/1988 | Biffle | 277/323 |
| 4,949,796 | A * | 8/1990 | Williams | 175/209 |
| 5,647,444 | A * | 7/1997 | Williams | 175/209 |
| 6,412,554 | B1 * | 7/2002 | Allen et al. | 166/80.1 |
| 6,668,684 | B2 * | 12/2003 | Allen et al. | 81/57.15 |
| 7,487,837 | B2 | 2/2009 | Bailey et al. | |
| 8,286,734 | B2 | 10/2012 | Hannegan et al. | |
| 8,322,432 | B2 | 12/2012 | Bailey et al. | |
| 8,499,854 | B2 | 8/2013 | Mitchell et al. | |
| 2011/0036638 | A1 | 2/2011 | Sokol et al. | |
| 2013/0032359 | A1 * | 2/2013 | Riggs | 166/378 |
| 2013/0264838 | A1 * | 10/2013 | Havens et al. | 294/215 |

* cited by examiner

*Primary Examiner* — Robert E Fuller
(74) *Attorney, Agent, or Firm* — Egbert Law Offices, PLLC

(57) ABSTRACT

An apparatus for installing and removing a rotary control device insert or an element thereof has a first clamp with a receptacle suitable for receiving a flange of the rotary control device insert therein, a second clamp having an interior suitable for extending around a pipe, and a plurality of lines extending between the first clamp and the second clamp. The first clamp is movable between an open position and a closed position. The second clamp is movable between an open position and a closed position. Each of the clamps includes a first jaw and a second jaw connected to the first jaw by a hinged connection.

4 Claims, 4 Drawing Sheets

APPARATUS AND METHOD FOR THE INSTALLATION OR REMOVAL OF A ROTARY CONTROL DEVICE INSERT OR A COMPONENT THEREOF

CROSS-REFERENCE TO RELATED APPLICATIONS

The present application claims priority from U.S. patent application Ser. No. 13/456,437, filed on Apr. 26, 2012, and entitled "Rubber Element Removal Tool", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to rotary control devices. More particularly, the present invention relates to the removal and installation of a rotary control device insert from or upon a drill pipe. Additionally, the present invention relates to the removal or installation of a bushing or insert of the rotary control device.

2. Description of Related Art including Information Disclosed Under 37 CFR 1.97 and 37 CFR 1.98.

Conventional oilfield drilling typically uses hydrostatic pressure generated by the density of the drilling fluid or mud in the wellbore in addition to the pressure developed by pumping of the fluid to the borehole. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with a low change in pressure. Underbalanced drilling is drilling with the hydrostatic head of the drilling fluid intentionally designed to be of a lower pressure than the pressure of the formations being drilled. The hydrostatic head of the fluid may naturally be of a lesser pressure than the formation pressure, or it can be induced.

These improved techniques have presented the need for pressure management devices, such as rotary control devices. These rotary control devices provide a dependable seal in the annular space between a rotating tubular and the casing or a marine riser for the purposes of controlling the pressure or fluid flow to the surface while drilling operations are conducted. Typically, a member of the rotary control device insert is designed to rotate with the tubular, along with the internal sealing elements or seals enabled by the bearings. The seal of the rotary control device insert permits the tubular to move axially and slidably through the rotary control device. The rotary control device has its bearings positioned above a lower sealing element or stripper rubber seal. An upper sealing element or stripper rubber seal is positioned directly and completely above the bearings. The rotary control device is positioned within a housing with a lateral outlet or port with a circular cross-section for drilling fluid returns. The diameter of the circular flange at the end of a circular conduit communicating with the port is substantially smaller than the combined height of the rotary control device and the housing.

As is known, rotary control devices have inserts or "components" that are generally radial and fabricated from synthetic rubber, such as neoprene or nitrile rubber. During drilling, the drill pipe is axially forced downwards through the rotary control device insert such that, over time, the rotary control device insert will incur wear and tear as the insert slidably engages the drill pipe. Thus, as a result of normal use, the rotary control device inserts will deteriorate and become less effective over time. Furthermore, high-temperature drilling fluid and/or any corrosive components of a drilling fluid will accelerate the deterioration of the rotary control device insert.

Whenever the rotary control device insert has deteriorated, it is important to be able to replace the insert or bushing of the rotary control device. Currently-practiced methods to remove the insert of the rotary control device are archaic and dangerous. Typically, heavy chains are placed upon the rotary control device and brute force is applied. As the insert releases from the drill pipe and is pulled over the upset of the drill pipe (sometimes requiring up to 60,000 pounds of pressure to release a 250-1600 pound insert element), the insert will swing free on the chains with great force. This causes the rotary control device and the insert thereof to swing around chaotically and dangerously.

As a result of the current techniques for the removal of the rotary control device insert, a significant danger is presented at the floor of the drilling rig. When the chains are applied, there is always the possibility of workers pinching or cutting their fingers through the use of such chains. Additionally, the force of the very heavy component that is swinging at the rotary table can contact other items associated with the drilling process. As a result, damage to these other items or tools associated with the drilling process can occur. Any contact between the insert of the rotary control device and a human being can cause severe injury, and possibly death, to the person. As such, need has developed so as to be able to control the rotary control device insert.

In the past, various patents have issued relating to rotary control devices. For example, U.S. Pat. No. 7,487,837, issued on Feb. 10, 2009 to Bailey et al., describes a riser rotary control device. A latch assembly is connectable to a riser. The rotary control device is positioned with the riser so as to seal the rotating control device with the latch assembly and removably latching the rotating control device to the latch assembly into the riser. The latch assembly is remotely actuated.

U.S. Pat. No. 8,286,734, issued on Oct. 16, 2012 to Hannegan et al., discloses a low-profile rotating control device. This rotating control device has its housing mounted on or integral with an annular blowout preventer seal, casing, or other housing. The outer diameter of the lateral outlet flange is substantially the same as the height of the rotary control device housing and bearing assembly after the bearing assembly is positioned. The sealing element is aligned with the lateral outlet.

U.S. Pat. No. 8,322,432, issued on Dec. 4, 2012 to Bailey et al. provides a subsea internal riser rotating control device system and method. The rotating control device is used to provide a system and method for sealing amarine riser having a rotatable tubular. A bypass internal channel or an external line may be used to allow fluid to bypass the rotary control device seal. The seal assembly can be a mechanically extruded seal or a hydraulically expanded seal in order to seal the rotary control device with the riser.

U.S. Pat. No. 8,499,854, issued on Aug. 6, 2013 to Mitchell et al., teaches a rotating control device, along with a system for cooling the rotating control device in the insert thereof during drilling operations. The system includes a body for connection between the rotating control device and a hot drilling fluid return outlet of a wellhead. The body includes an inlet for injecting cool drilling fluid adjacent the insert and an outlet for removing partially warm drilling fluid. During operation, cool drilling fluid is circulated through the inlet and outlet such that cool drilling fluid is in direct contact with hot drilling fluid recovered from the well in a buffer zone adjacent the hot drilling fluid return outlet.

U.S. Patent Publication No. 2011/036638, published on Feb. 17, 2011 to Sokal et al., provides a system and method for a low-profile rotating control device and the housing mounted on or integral with the annular blowout preventer seal. The rotary control device is removably disposed within the housing by rotating a bearing assembly rotating plate. A sealing element is removably disposed within the rotary control device bearing assembly by rotating a seal retainer ring.

Unfortunately, in these prior art patents, there is no technique disclosed for the safe removal of the insert from the rotary control device. Although these systems can work effectively for creating the seal between the tubular and the casing, these patents do not disclose any technique for the safe removal of the rotary control device and/or the components thereof.

It is an object of the present invention to provide an apparatus and method for the installation and/or removal of a rotary control device insert that is extremely safe.

It is still another object the present invention to provide an apparatus and method for the installation and/or removal of the rotary control device insert which avoids the wild swinging and movement of the insert or rotary control device.

It is still another object of the present invention to provide an apparatus and method for the installation and/or removal of a rotary control device insert that can be easily applied to the rotary control device insert.

It is still further object of the present invention to provide an apparatus and method for the installation and/or removal of a rotary control device insert that is easy-to-use, relatively inexpensive, and easy to manufacture.

These and other objects and advantages of the present invention will become apparent from a reading of the attached specification and appended claims.

BRIEF SUMMARY OF THE INVENTION

As used herein, various terms are particularly applied to the various components associated with the present invention. In particular, the term "line" is used herein so as to describe the connection between a first clamp and a second clamp. This "line" can include slings, chains, cables, bands, wire rope and similar items. The term "rotary control device" includes the rotary control device, along with any components thereof, such as the insert and/or bushing. The term "sling" is used herein in the broad sense so as to include both chains, lines, cables, wire rope, straps and similar items.

The present invention is an apparatus for installing or removing a rotary control device insert or a component thereof. The apparatus of the present invention includes a first clamp having a receptacle suitable for receiving a flange of the rotary control device insert therein, a second clamp having an interior opening suitable for extending around a pipe, and a plurality of lines extending between the first clamp and the second clamp. The first clamp is movable between an open positioned and a closed position. The second clamp is also movable between an open position and a closed position.

In the present invention, the first clamp comprises a first jaw and a second jaw connected to the first jaw by a hinged connection. The first jaw has an end opposite the hinged connection that is connected with an end of the second jaw when the first clamp is in the closed position. The end of the first jaw has a female connector and the end of the second jaw has a male connector. The male connector is engageable with the female connector when the first clamp is in the closed position. The female connector has a hole extending therethrough. The male connector also has a hole extending therethrough. The holes of the female connector and the male connector are aligned when the first clamp is in the closed position. A pin can be removably received through the holes of the male and female connectors.

The first clamp defines a ring extending in a plane. The first clamp includes a plurality of legs extending outwardly of the ring in a direction transverse to the plane of the ring. At least one shoe is affixed to at least one of the plurality of legs. The shoe has a catch tooth extending inwardly therefrom. The catch tooth is suitable for defining a portion of the receptacle of the first clamp. This shoe can include a plurality of shoes that are respectively removably connected to the plurality of legs.

The first clamp has a first handle extending outwardly of the first clamp in a location adjacent the end of the first jaw. The first clamp also includes a second handle extending outwardly of the first clamp in a location adjacent to the end of the second jaw. A housing is affixed to a surface of the first clamp adjacent to the interior opening. This housing has at least one roller bearing positioned at an end thereof at the interior opening. The roller bearing is suitable for rollably contacting the drill pipe. In particular, the housing can include a plurality of such housings that are positioned on the outer surface of the first clamp. This plurality of housings radiate away from the interior opening. The roller bearing includes a plurality of roller bearings that are respectively received in the plurality of housings.

The first clamp has a plurality of eye brackets affixed thereto. A plurality of slings are respectively affixed to the plurality of eye brackets and extend outwardly therefrom.

The second clamp includes a first jaw and a second jaw that is connected the first jaw by a hinged connection. The first jaw has an end opposite the hinged connection that is engaged within end of the second jaw when the second clamp is in the closed position. A plurality of slings are connected to the second clamp and extend outwardly therefrom on a side of the second clamp opposite to the plurality of lines.

The present invention is also a method for removing a rotary control device or a component of the rotary control device insert from a drill pipe. This method includes the steps of: (1) affixing a first clamp against a flange of the rotary control device insert; (2) affixing a second clamp around the drill pipe stump; (3) lifting the drill pipe upwardly such that the rotary control device insert moves with the drill pipe until the plurality of lines between the first clamp and the second clamp tighten; and (4) continually lifting the drill pipe such that the drill pipe moves independently with respect to the fixed position of the rotary control device insert until the drill pipe is separated from the rotary control device insert. This method further includes connecting the first clamp to a hoisting line extending above the rotary control device insert. The first clamp and the rotary control device insert are lowered to a location away from the drill pipe stump. The first clamp is then released from the flange of the rotary control device insert. The second clamp is also released from the drill pipe stump. The step of affixing the first clamp includes opening a first jaw and a second jaw about a hinged connection, positioning the rotary control device insert within the open first and second jaws, and closing the first and second jaws such that ends of the first and second jaws opposite the hinged connection are locked together.

The present invention is also a method of attaching a rotary control device insert or a component thereof to a drill pipe. This method includes the steps of: (1) affixing a first clamp against the flange of the rotary control device insert; (2) affixing a second clamp around the drill pipe in a location above the first clamp; and (3) moving the hoisting line upwardly or moving the drill pipe downwardly such that the stem of the drill pipe passes through an interior of the rotary control device insert. In this method, the first clamp is released from the flange of the rotary control device insert. The second clamp is released from the drill pipe after the stem of the drill pipe is positioned through the rotary control device insert. The rotary control device insert is positioned in a location away from the drill pipe. The first clamp is affixed to the rotary control device at this location. The first clamp in the rotary control device insert is hoisted upwardly toward the drill pipe. The hoisted rotary control device insert is positioned directly below the drill pipe.

The foregoing Section is intended to describe, with particularity, the preferred embodiment of the present invention. It is understood that modifications to this preferred embodiment can be made within the scope of the present invention. As such, this Section should not be construed, in any way, as limiting of the broad scope of the present invention. The present invention should only be limited by the following claims and their legal equivalents.

DETAILED DESCRIPTION OF THE INVENTION

Figure 1:
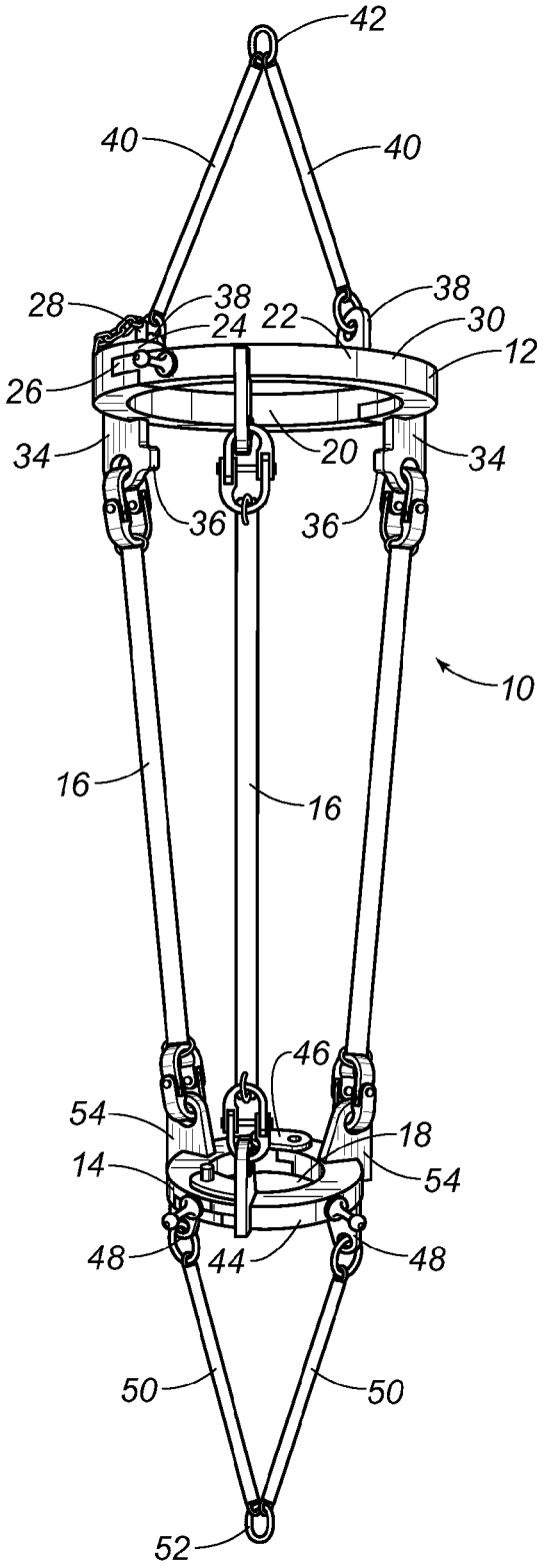
FIG. 1 is a perspective view showing the apparatus of the present invention.

Referring to FIG. 1, there is shown the apparatus 10 for the installation or removal of a rotary control device insert from a drill pipe. The apparatus 10 includes a first clamp 12, a second clamp 14, and a plurality of lines 16 extending between the first clamp 12 and the second clamp 14. The first clamp will include a receptacle suitable for receiving a flange of the rotary control device insert therein. The first clamp 12 is movable between an open position and a closed position. The second clamp 14 has an interior opening 18 that is suitable for extending around a pipe. The second clamp 14 is also movable between an open position and a closed position. It can be seen in FIG. 1 that the lines 16 includes three lines. In the preferred embodiment the present invention, these lines 16 are in the nature of slings that extend between the first clamp 12 and the second clamp 14.

In FIG. 1, it can be seen that the first clamp 12 includes a first jaw 20 and a second jaw 22. The first jaw 20 includes a female connector 24 at an end thereof. The second jaw 22 has a male connector 26 at an end thereof. The opposite end of the jaws 20 and 22 will be hingedly connected together. The female connector 24 will have a hole extending therethrough. Similarly, the male connector 26 will have a hole extending therethrough. A pin 28 will extend through the holes of the female connector 24 and the male connector 26 so as to lock the first clamp 12 into its closed position.

The first clamp 12 is in the form of a ring 30 that extends in a plane. The ring 30 has an underside 32 that will be suitable for abutting a surface of the flange of the rotary control device insert. A plurality of legs 34 extend downwardly from the ring 30. Each of the legs 34 includes a catch tooth 36 that is suitable for engaging with another surface of the flange of the rotary control device insert. As such, the catch tooth 36 and the underside 32 of the ring 30 will form a receptacle for the tight receipt of the flange of the rotary control device insert therein. The lines 16 are respectively connected to the legs 34 so as extend downwardly toward the second clamp 14.

The first clamp 12 has eye brackets 38 extending upwardly therefrom. Slings 40 are respectively secured to the eye brackets 38. A shackle or ring 42 (or similar item) secures the opposite ends of the slings 40. As such, the shackle 42 can be used so as to provide a lifting force to the first clamp 12, along with the lines 16 and the second clamp 14.

The second clamp 14 defines an interior opening 18 suitable for allowing a drill pipe to extend therethrough. The second clamp 14 includes a first jaw 44 and a second jaw 46. A pin can be utilized so as to join the jaws 44 and 46 together at an end opposite the hinged connection. The second clamp 14 also includes the eye brackets 48 which extend downwardly therefrom. Eye brackets 48 are connected to slings 50. A shackle or ring 52 is joined to the opposite ends of the slings 50 from the eye brackets 48. The second clamp 14 also includes eye brackets 54 that extend upwardly therefrom. Eye brackets 54 are suitable for joining the second clamp 14 to the lines 16. In certain of the subsequent figures, the slings 40 and 50 are omitted for clarity.

Figure 2:
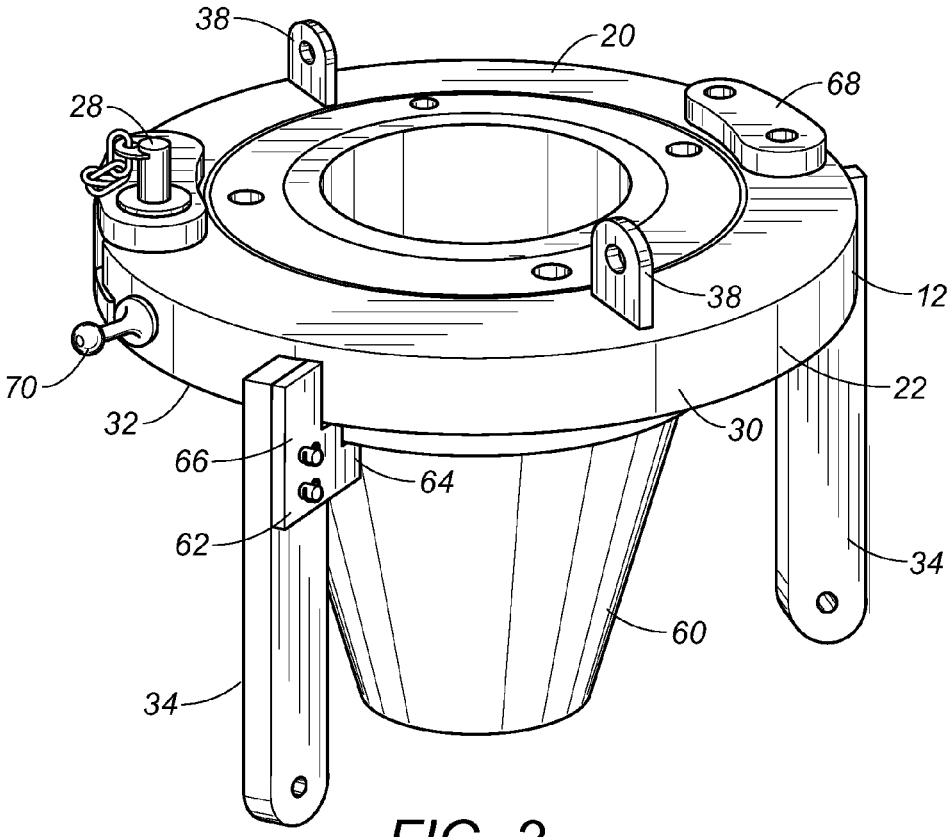
FIG. 2 is a perspective view showing the application of the first clamp of the apparatus of the present invention upon the rotary control device insert.

FIG. 2 is an illustration showing the first clamp 12. The rotary control device insert 60 is illustrated as received by the first clamp 12. FIG. 2 shows that the ring 30 has legs 34 extending downwardly therefrom. Importantly, there is a shoe 62 as affixed to the legs 34. The shoe 62 has a catch tooth 64 which extends outwardly therefrom so as to bear against the flange of the rotary control device insert 60. The shoe 62 has a plate 66 that is affixed by screws, bolts, or other types of fasteners to the legs 34. As such, within this concept of the present invention, the shoe 62 is adaptable so as to accommodate the various thicknesses of flanges that are associated with various rotary control device inserts. For example, if the flange of the rotary control device insert is relatively thick, then the shoe 62 can be moved so as to accommodate the thicker flange. As such, this provides great adaptability of the apparatus 10 to various designs of rotary control device inserts.

In FIG. 2, it can be further seen that the ring 30 has the eye brackets 38 extending upwardly from the top surface thereof. The first jaw 20 and the second jaw 22 are illustrated as joined by a hinge connection 68. The opposite end of the jaws 20 and 22 are connected and joined by the pin 28. A handle 70 is affixed to the periphery of the ring 30 and extends radially outwardly therefrom. Another handle can be provided on the jaw 20 and extend outwardly therefrom on a side opposite the connection between the ends of the jaws 20 and 22. As such, these handles can facilitate the ability to manually open and close the first clamp 12 around the flange of the rotary control device insert.

Figure 3:
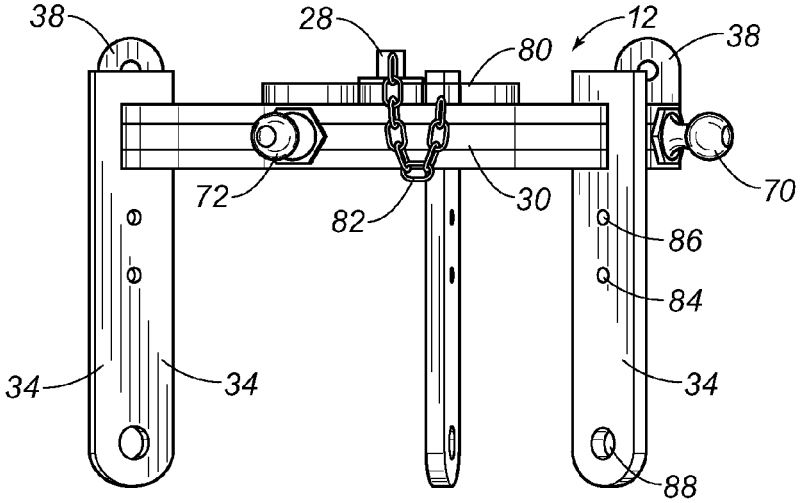
FIG. 3 is a side elevational view showing the first clamp of the apparatus of the present invention.

FIG. 3 is a side elevational view showing the configuration of the first clamp 12. In FIG. 3, it can be seen that the first handle 70 extends outwardly of the ring 30. Similarly, a second handle 72 will extend outwardly of the ring 30. Each of the handles 70 and 72 are on opposite sides of the pin 28. In FIG. 3, it can be seen that the pin 28 is secured to a plate 80 through the use of a chain 82. As such, the pin 28 will not be misplaced or lost during the installation process.

FIG. 3 further illustrates the configuration of the legs 34 which extend downwardly from the ring 30. The legs 34 include suitable holes 84 and 86 that are used to secure the shoe 62 thereto. Each of the legs 34 further includes a hole 88 at the bottom thereof. Hole 88 is suitable for joining with the lines 16. The eye brackets 38 are illustrated as extending upwardly from the top surface of the ring 32 of the first clamp 12.

Figure 4:
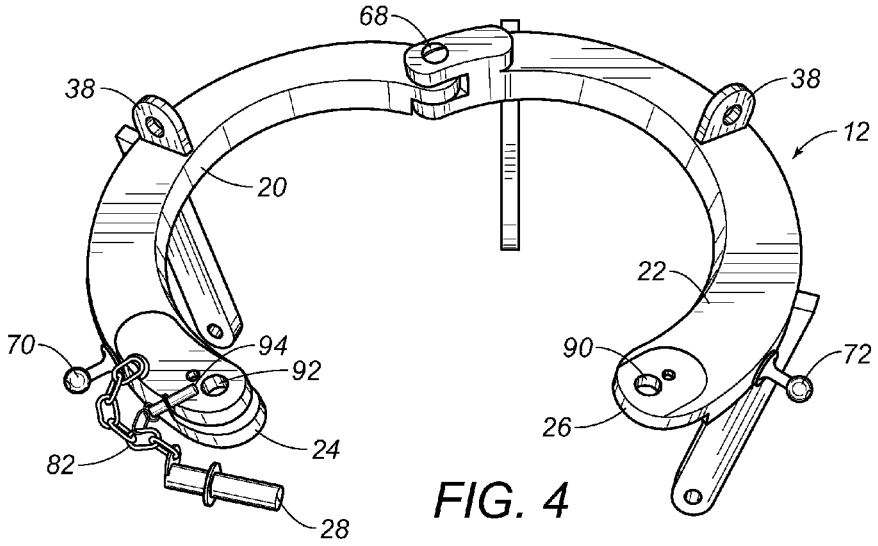
FIG. 4 is a perspective view showing the first clamp of the apparatus of the present invention in an open position.

FIG. 4 shows the first clamp 12 in an open configuration. It can be seen that the clamp 12 includes the first jaw 20 and the second jaw 22. The first jaw 20 includes the female connector 24 at one end thereof. The second jaw 22 has the male connector 26 at an end. The opposite ends of the jaws 20 and 22 are joined at the hinged connection 68. Handle 70 extends outwardly from the outer surface of the first jaw 20. Handle 72 extends outwardly of the outer surface of the second jaw 22. When the pin 28 is removed from the male connector 26 and the female connector 24, the handles 70 and 72 can be utilized by the worker so as to move the first clamp 12 to its open position. As such, the jaws 20 and 22 will pivot at the hinge connection 68.

The male connector 26 is illustrated as having a hole 90 extending therethrough. Similarly, the female connector 28 has a hole 92 extending therethrough. When the jaws 20 and 22 are pivoted toward each other and the male connector 26 is inserted within the slot of the female connector 24, the holes 90 and 92 will align. In this configuration, the pin 28 can be inserted through the holes 90 and 92 so as to lock the jaws 20 and 22 together around the flange of the rotary control device insert. A safety pin 94 is also provided along with pin 28. Safety pin 94 can be in the nature of a push-type pin that can be inserted into a hole also formed into the female connector 24 and the male connector 26. As such, two points of locking are achieved so as to assure that the jaws 20 and 22 do not come apart during use. Chain 82 is illustrated as connecting the pin 28 to the first jaw 20.

Figure 5:
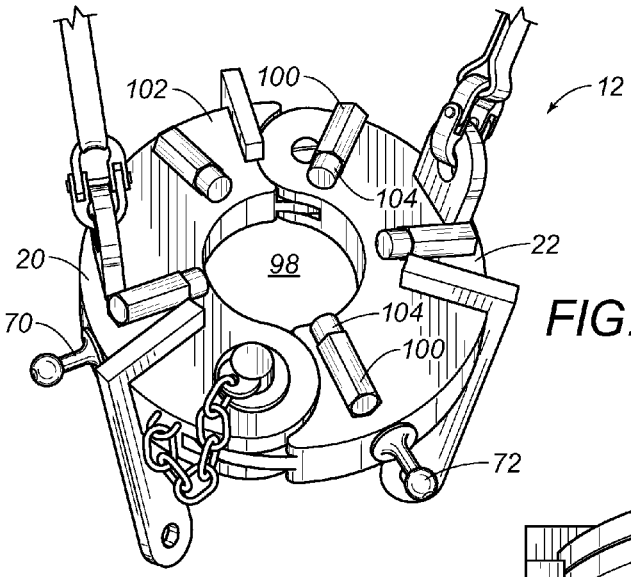
FIG. 5 is a perspective view showing the first clamp of the apparatus of the present invention in a closed position.

FIG. 5 illustrates that the first jaw 20 is locked to the second jaw 22. The pin 28 will extend through the respective holes 90 and 92. As such, the interior opening 98 is defined between the first jaw 20 and the second jaw 22.

Importantly, in the present invention, there are plurality of housings 100 that are positioned on the top surface 102 of the first clamp 12. Each of these housings 100 has a roller bearing 104 at an end thereof adjacent the interior opening 98. These roller bearings 104 will extend slightly into the opening 98 so as to provide a surface suitable for bearing against an outer surface of a drill pipe extending through the interior opening 98. Each of the housings 100 includes a suitable set screw arrangement whereby the location of the roller bearings 104 can be adjusted so as to accommodate various diameters of drill pipe. It has been found that the use of the roller bearings 104 assures that damaging or frictional contact between the interior surfaces of the jaws 20 and 22 and the exterior surface of the drill pipe is effectively avoided. The roller bearings 104 will allow the drill pipe to contact the roller bearings and smoothly glide therealong rather than contact the inner surfaces of the jaws 20 and 22. Each of the housings 100 is positioned so as to extend radially away from the interior opening 98. As shown in FIG. 5, total of five housings 100 are provided. Within the concept of the present invention, fewer or more than five housings 100 can be provided, as required.

The use of the roller bearings 104 further provides an anti-rotation capability to the present invention. If the roller bearings 104 were not included, then a frictional contact between the drill pipe and the inner walls of the interior opening 98 would cause the first clamp 12 to rotate in correspondence with the rotation of the drill pipe. However, the roller bearings 104 will allow the drill pipe to rotate without causing the clamp 12 to rotate along with the drill pipe. As such, any twisting of the lines 16 or of the slings 40 is effectively avoided through the use of the present invention.

Figure 6:
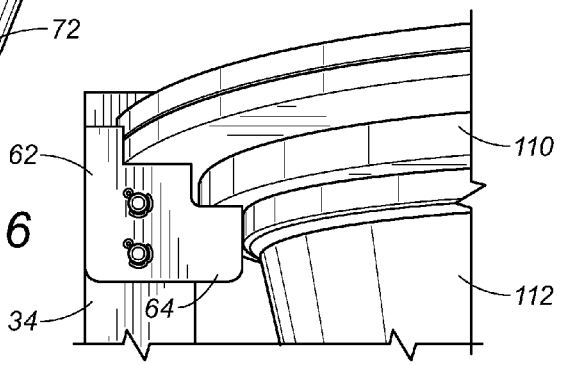
FIG. 6 is a detailed view showing the relationship between the shoe and the flange of the rotary control device insert.

FIG. 6 is a detailed view showing the shoe 62 abutting the flange 110 of the rotary control device 112. In particular, it can be seen that the shoe 62 has a surface that is directly mounted upon a surface of the leg 34. A catch tooth 64 will extend inwardly from the leg 34 so as to engage the underside of the flange 110. The catch tooth 64 can be elongated so as to bear along a portion of the curvature of the flange 110. The shoe 62 can be of various sizes. The shoe 62 can be removably mounted to the leg 34, as required, so as to accommodate the various sizes and shapes of flanges associated with various models of rotary control devices and inserts thereof.

Figure 7:
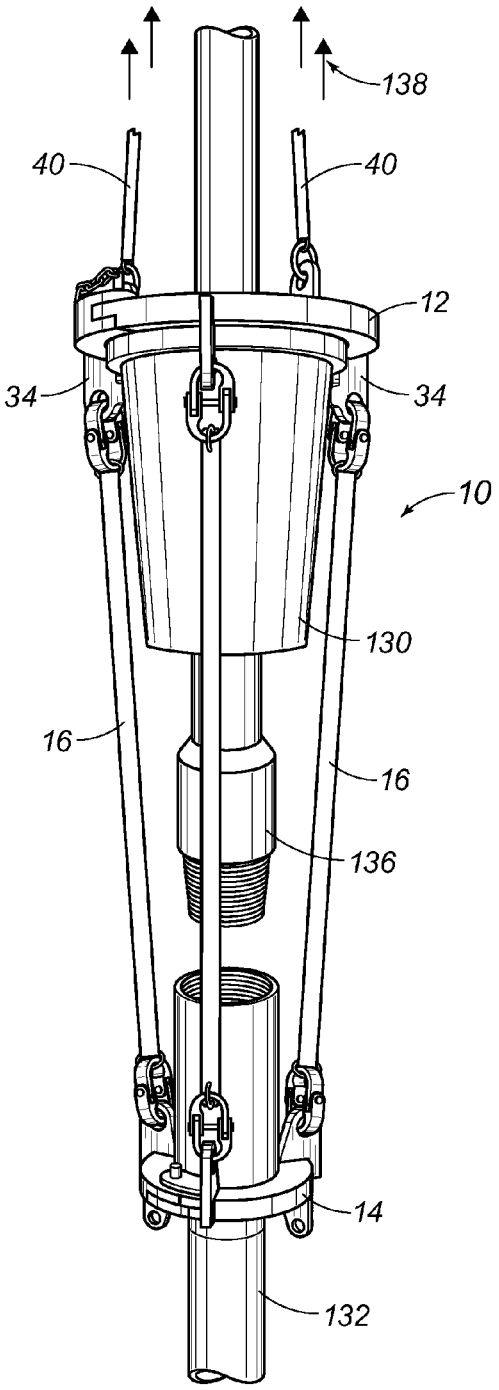
FIG. 7 is a side elevational view showing the method of removing the rotary control device insert.

FIG. 7 shows the application of the apparatus 10 of the present invention in association with the removal of the rotary control device insert 130. In particular, can be seen that the first clamp 12 is positioned over the flange of the rotary control device insert 130. The second clamp 14 is positioned around the pipe 132. The pipe 132 includes a box (or "upset") 134. The interior opening of the second clamp 14 will have a diameter less than the outer diameter of the box 134 of the pipe 132. The lines 16 will extend between the first clamp 12 and the second clamp 14. The circumference of the first clamp 12 can be changed to fit any size of rotary control device or the insert associated with such a rotary control device. The size of the lower clamp 14 can be changed to fit any size of drill pipe. The slings 40 are secured to the first clamp 12 so as to allow the rig operator to lift, control, or position the clamp 12 and lines 16 using a hoist or similar means. The drill stem 136 is ultimately pulled vertically upwardly through the rotary control device insert 134 of the rotary control device 130 through the elevator at the drill rig in the direction illustrated by the arrows 138 in FIG. 7. The threaded end 140 of the drill stem 136 is shown as disconnected from the pipe 132. The drill pipe that travels vertically downwardly into the ground is extremely heavy. The second clamp 14 is affixed around the stump of the pipe 132. As such, it provides a great deal of stability and leverage during the operation of the first clamp 12.

In operation, the apparatus 10 is used in the following manner to remove seals, inserts, bushings, or other elements or components from the pressure control tools, such as rotary control device inserts. The first clamp 12 opens by removing the pin 28 and, if necessary, the safety pin 94. This will allow the jaws of the first clamp to open. The hinged connection 68 will allow the jaws to pivot with respect to each other. The first clamp 12 will be placed around the rotary control device insert 130. Although in the illustration of FIG. 7, the first clamp is shown around the top of a rubber or elastomeric element, in some rotary control device models, the ring may be more appropriately placed around a different aspect of the rubber or elastomeric element, such as the middle of such element. As the first clamp 12 is lowered onto the rotary control device insert 130, the flange of the rotary control device insert will be secured between the catch tooth of the shoe and the groove on the inside of the first clamp 12. This allows the first clamp 12 to open slightly and then close once the flange is located within the receptacle of the first clamp 12. Once the first clamp 12 is closed, the primary pin 28 and the safety pin 94 are inserted through the respective holes at the male and female ends of the first and second jaws of the first clamp 12. The legs 34 serve to secure the rotary control device insert 130 against the underside of the first clamp 12 and serve as a "cage" for the retention of the rotary control device insert. This allows the rig operator to control and lower the rotary control device insert 130 after it is freed from the drill stem 136.

The second clamp 14 opens by removing a primary pin and a safety pin in the nature of the first clamp. The jaws of the second clamp 14 can be pulled part in the same manner as the first clamp. The hinged connection between the jaws of the second clamp allow the second clamp to move from the closed position to the open position. Once opened, the second clamp 14 is placed around the drill stem and the hinged jaws are closed. The primary pin and safety pin can then be inserted through the respective holes in the ends of the jaws of the second clamp 14.

Once the first clamp 12 and the second clamp 14 are closed and the pins are inserted, the rig operator can begin to lift the drill stem 136 along with the rotary control device insert 130. As the drill stem 136 and the rotary control device insert 130 are lifted, the upper side of the second clamp 14 will abut the upset 134 of the drill pipe stump 132 so as to cause the second clamp 14 to remain stationary. The lines 16 that suspend the second clamp 14 vertically from the upper clamp 12 begin to tighten. At this point, the rig operator will tighten the slings 40. Once the lines 16 are taught, the slings 40 are held by the hoist. The rig operator can then begin lifting the drill stem 136. As the rig operator continues to pull upwardly, the drill stem 136 begins to slide up through the now-stationary rotary control device insert 130. The first clamp 12 and the rotary control device insert 130 remain stationary because the second clamp 14 is closed upon the drill pipe stump 134. The rotary control device insert 130 will begin to slip off the bottom of the drill stem 136 as the drill stem 136 is lifted upwardly through the interior of the rotary control device insert 130. When the drill stem 136 is released, the weight of the first clamp 12 and the rotary control device insert 130 are left hanging free of the drill stem 136 by the hoist or other lifting device.

Once the rotary control device insert is released, the first clamp 12 and the rotary control device insert 130 are lowered by releasing tension on the plurality of lines 16. This will release the contact pressure between the second clamp 14 and the upset 134 of the pipe 132. The second clamp 14 is then opened by removing the primary and safety pins and pulling apart the jaws. The first clamp 12 and the rotary control device 130 can then be lowered to the ground. Once at the ground, the first clamp 12 is opened by removing the primary pin and safety pin and by pulling apart the jaws. The rotary control device insert 130 can then be released from the first clamp 12.

Figure 8:
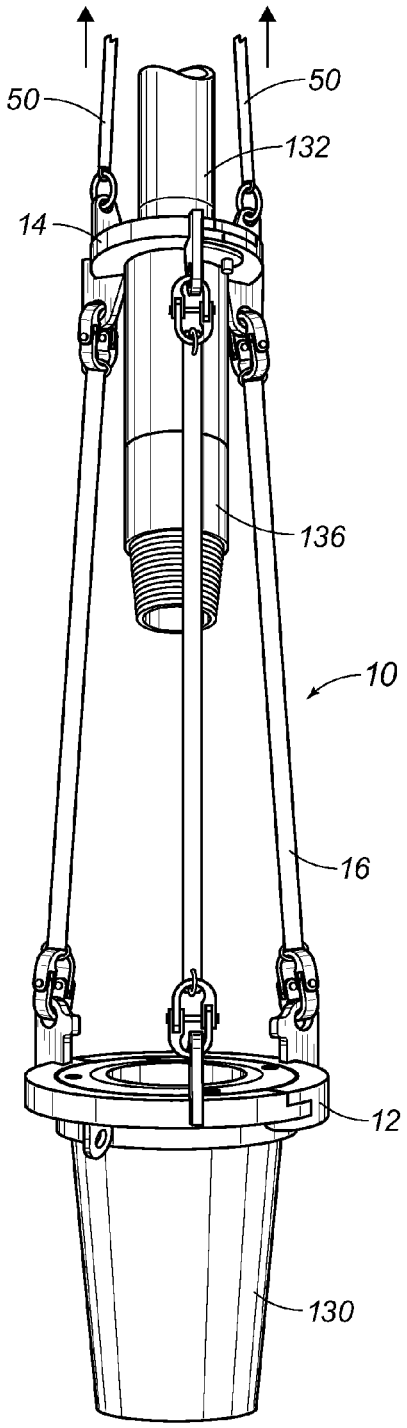
FIG. 8 is a illustration of the method of installing the rotary control device insert.

FIG. 8 illustrates the technique for installing the rotary control device 130 upon the drill stem 136. In particular, the apparatus 10 of the present invention is inverted in order to accomplish this task. In other words, the first clamp 12 will be located at the bottom and the second clamp 14 is located at the top. Initially, the first clamp 12 is joined to the flange of the rotary control device insert 130. It can then be hoisted by the hoist lines 50 which extend from the second clamp 14. This hoisting will cause the first clamp 12 to move the rotary control device insert 130 into a position directly below the drill stem 136. Once the rotary control device insert 130 is located below the drill stem 136, the second clamp 14 can be closed around the outer diameter of the pipe 132. The hoist lines 50 can then be pulled upwardly so that the drill stem 136 can pass through the interior of the rotary control device insert 130. Alternatively, the elevator at the drill rig can lower the pipe 132 such that the drill stem 136 will pass through the interior of the rotary control device insert 130.

Once the rotary control device insert 130 is installed upon the drill stem 136, the second clamp 14 can be released from the pipe 132. Additionally, the first clamp 12 can be released from the flange of the rotary control device insert 130. As such, the rotary control device insert 130 will remain as installed upon the drill stem 136.

The foregoing disclosure and description of the invention is illustrative and explanatory thereof. Various changes in the details of the illustrated construction can be made within the scope of the present invention without departing from the true spirit of the invention. The present invention should only be limited by the following claims and their legal equivalents.

We claim:

1. A method for removing a rotary control device insert or a component of the rotary control device from a drill pipe, the method comprising:

affixing a first clamp against the rotary control device insert;

affixing a second clamp around a drill pipe stump, said first clamp connected to said second clamp by a plurality of lines;

lifting the drill pipe upwardly such that the insert moves with the drill pipe until said plurality of lines tightens; and continually lifting the drill pipe such that the drill pipe moves independently with respect to a fixed position of the rotary control device insert until the drill pipe is separated from the rotary control device insert.

2. The method of claim 1, further comprising:

connecting the first clamp to a hoisting line extending above the rotary control device insert;

lowering the first clamp and the rotary control device insert to a location away from the drill pipe stump; and releasing said first clamp from the flange of the rotary control device insert.

3. The method of claim 2, further comprising:

releasing said second clamp from the drill pipe stump.

4. The method of claim 1, wherein the first clamp has a first jaw and a second jaw that are connected by a hinged connection, the step of affixing said first clamp comprising:

opening said first jaw and said second jaw about the hinged connection;

positioning the rotary control device insert within the opened first and second jaws; and closing said first and second jaws such that the ends of said first and second jaws opposite the hinged connection are locked together.

* * * * *